United States Patent [19]

Holm

[11] 4,424,087

[45] Jan. 3, 1984

[54] METHOD FOR DESENSITIZING PARTICLE FORMED SOLID EXPLOSIVE SUBSTANCES

[75] Inventor: Boris Holm, Karlskoga, Sweden

[73] Assignee: Aktiebolaget Bofors, Bofors, Sweden

[21] Appl. No.: 393,159

[22] Filed: Jun. 28, 1982

[30] Foreign Application Priority Data

Jul. 1, 1981 [SE] Sweden ..... 8104103

[51] Int. Cl.[3] ..... C06B 45/02

[52] U.S. Cl. ..... 149/21; 149/105; 149/109.6

[58] Field of Search ..... 149/21, 105, 109.6

[56] References Cited

U.S. PATENT DOCUMENTS

| | | | |
|---|---|---|---|
| 3,356,546 | 12/1967 | Dick et al. | 149/47 |
| 3,472,713 | 10/1969 | Berthmann et al. | 149/105 |
| 3,619,305 | 11/1971 | DeBrancion | 149/43 |
| 3,713,918 | 1/1973 | Forshey et al. | 149/43 |
| 4,231,822 | 11/1980 | Roth | 149/105 |

*Primary Examiner*—Stephen J. Lechert, Jr.
*Attorney, Agent, or Firm*—Pollock, Vande Sande & Priddy

[57] ABSTRACT

The invention deals with a method for temporarily eliminating those risks associated with transporting, storing and generally handling particle formed solid explosive substances. According to the invention this is achieved (desensitizing the explosive substance) by mixing the said explosive substance with a non-explosive substance which relative to the explosive substance is an inert particle formed solid material (desensitizing substance) having by and large the same particle size as that of the explosive substance. Salts, and in particular calcium chloride, containing chloride ions have been shown to be excellent as desensitizing substances. A mixture of trinitrobenzene (TNB) and calcium chloride ($CaCl_2$) where the content of $CaCl_2$ is greater than or equivalent to 55% by weight should not be classified as an explosive substance.

20 Claims, No Drawings

METHOD FOR DESENSITIZING PARTICLE FORMED SOLID EXPLOSIVE SUBSTANCES

This invention relates to a method for the temporary elimination of the risks involved in the transport, storage, and general handling of particle formed solid explosive materials and/or other particle formed solid explosive substances.

As a general designation for a method of temporarily rendering an explosive substance non-explosive, the expression desensitization will be used. Consequently this invention can be defined as a method for the desensitization of particle formed solid explosive substances.

A large number of explosive substances of which many at present are used exclusively as explosives, could in the future be widely used as base materials in various chemical processes on condition that the risks of explosion associated with them during normal handling, transportation, and storage could be eliminated. At present similar substances can only be used after considerable safety measures have been taken making them only available to the purely explosives industry. The principle intention of this invention is to make these types of solid explosive substances available to any chemical industry wishing to use them.

An example of a solid explosive substance which to a certain extent is already in use as a base material in chemical technology and the use of which will in all probability increase greatly in the future, is trinitrobenzene (TNB). An example of a purely military explosive material which could arouse great civilian interest as a base material on condition that the safety aspects could be solved satisfactorily, is trinitrotoluene (TNT).

This invention deals with a method of temporarily desensitizing particle formed solid explosive substances i.e. render them non-explosive. By this is meant that the said substances shall be safe from detonation even if they are subjected to reasonably strong initiating detonations, sparks, blows, or heat. By the expression temporary in this context is meant that irrespective of what is done to the explosive substance to make it handlings-safe this can only be permitted to involve such as can easily be eliminated so that only the completely pure original substance is restored. A further requirement of the desensitizing substance is that it shall be stable in storage i.e. a longer period of storage must not cause a change in the chemical composition or a gradual deterioration of the desensitizing effect of the said substances.

It has now been shown that particle formed solid substances can be desensitized simply by mixing the substance in question with a sufficient quantity of particle formed non-explosive material which in itself is indifferent to the explosive substance. It has also been shown that different materials all of which fulfil the abovementioned requirements function varyingly well i.e. varying quantities of the materials in question are required to produce a safe mixture.

Salts containing chloride ions have shown themselves to be especially suitable as desensitizing substances. The absolutely best desensitizing substance has been shown to be calcium chloride. However for practical reasons sodium chloride and iron (II) chloride ($FeCl_2$) should be considered even if somewhat greater quantities are required than is necessary with calcium chloride.

Experiments indicate that a substance as explosive as trinitrobenzene can be desensitized by being mixed with just over 50% by weight calcium chloride. Using sodium chloride or iron (II) chloride a rather larger quantity would be required. In this context it can be said that calcium chloride and iron chloride containing water of crystallization are being considered.

The requirement of storage stability means that both the explosive substance and the desensitizing substance should have approximately the same grain as dry mixtures containing varying grain fractions have a tendency to separate when they are subjected to continual shaking or vibration. The grain size and construction of both the explosive substance and the desensitizing substance probably has a certain influence on the tendency of the mixture to separtate when shaken and/or vibrated but this behaviour is both difficult to ascertain and define clearly. However it has been ascertained that the desensititzing substance can be permitted to have a mean grain size which ranges from twice to half the mean grain size of the explosive substance without endangering the storage stability of the mixture.

In order to able to be used as a base component in a chemical process desensitization must be temporary, i.e. it must be easy to restore the original substance in pure form. The requirement that the original substance shall be easy to restore must not endanger the stability of the desensitized substance. As far as the desensitizing of explosive substances which are non-soluble in water are concerned, desensitizing substances which are easily soluble in water are to be preferred as they can easily be washed away by water as soon as it is desired to restore the explosive substance in pure form. It is also desirable in this context that the water solution containing the desensitized substance does not give rise to environmental problems of its own. Among the particle formed substances which were tested and shown to be either completely unsuitable or rather poor as desensitizing substances can be mentioned lactose, sodium sulphate, iron oxide ($Fe_2O_3$), and iron powder.

This invention is defined in the patent claims and will be illustrated further by some examples.

TESTING

The following test compositions were subjected to one or more of the tests described briefly below.

For the detonation test the test composition was packed in a steel tube of predetermined dimensions together with an electrically initiated standard detonator. By assessment of the consequently shattered tube it can be directly ascertained if the test composition detonated or if only the detonator caused the damage.

The deflagration test is used to ascertain whether or not the open upper surface can be ignited by a naked flame.

For the steel tube test the composition is heated intensely in a steel tube either electrically or by means of a bunsen burner. The heat shall be so intense as to cause the test composition to disintegrate. In order to assess the sensitivity of the various test compositions this can be measured at the largest nozzle opening in the steel tube at which the said tube bursts due to the build up of pressure caused by the disintegration of the test composition. An easier method of comparing the sensitivity of various mixtures is to utilize a standardised nozzle opening and test composition and measure the time taken and the amount of thermal energy needed to shatter the steel tube. In the tests listed below a nozzle opening of 1.0 mm and a test composition weighing 15 g were used in all cases. The values given in the following table apply to tests carried out using electric heating.

STEEL TUBE TESTS

| Mixing ratio in % by weight explosive substance/ desensitizing substance | | Time to detonation (s) | Energy created on detonation (KJ) |
|---|---|---|---|
| TNB/$Fe_2O_3$ | 30:70 | 56 | 16,5 |
| " | 50:50 | 51 | 15,7 |
| TNB/$FeCl_2.4H_2O$ | 30:70 | No detonation | |
| " | 40:60 | 157 | 48,4 |
| TNB/$Na_2SO_4$ | 50:50 | 88 | 26,5 |
| TNB/Fe-powder | 50:50 | 101 | 30,0 |
| TNB/LACTOSE | 50:50 | 66 | 19,4 |
| TNB/$CaCl_2.CH_2O$ | 40:60 | No detonation | |
| " | 50:50 | " | |
| " | 60:40 | 216 | 65,1 |
| " | 80:20 | 135 | 45,0 |
| TNB/NaCl | 50:50 | 122 | 39,6 |
| " | 80:20 | 111 | 31,9 |

The detonation testing showed that mixtures of 50:50% TNB/$CaCl_2$ could be made to explode while mixtures of 45:55% could not. The steel tube test was also carried out using mixtures of 45:55% TNB/$CaCl_2$ and heat with a gas flame without causing an explosion. A comparable deflagration test also showed that a mixture of 45:55% TNB/$CaCl_2$ could not be lit by a naked flame.

Mixtures of 45:55% TNB/$CaCl_2$ were also subjected to conventional drop chamber tests where a two kilogramme weight dropped from a height of 150 cm did not cause an explosion.

Consequently it has been ascertained at the very least that a homogeneous mixture of TNB/$CaCl_2$ containing a maximum of 45% by weight TNB should be considered a non-explosive substance.

In this context it can also be motivated to point out that other limit values seem to apply for other particle formed explosive substances. For example with regard to TNT greater quantities of desensitizing material are required than for TNB.

I claim:

1. A method for temporarily rendering an explosive substance non-explosive, which comprises adding to a solid particle formed explosive substance more than 50% by weight of a particle formed, chloride ion-containing salt having substantially the same mean particle size as said explosive substance and being easily washed out of the composition with water.

2. The method of claim 1 wherein said explosive substance is selected from the group of 1,2,3-trinitrobenzene and 2,4,6-trinitrotoluene.

3. The method of claim 1 wherein the amount of said salt is at least about 55% by weight of the composition.

4. The method of claim 1 wherein the mean particle size of said salt is not less than one-half of or twice as large as the mean particle size of said explosive substance.

5. The method of claim 4 wherein said salt is calcium chloride ($CaCl_2$).

6. The method of claim 4 wherein said salt is selected from the group of sodium chloride and iron (II) chloride ($FeCl_2$).

7. The method of claim 1 wherein said salt is calcium chloride ($CaCl_2$).

8. The method of claim 1 wherein said salt is selected from the group of sodium chloride and iron (II) chloride ($FeCl_2$).

9. The method of claim 1 wherein said explosive is 1,3,5-trinitrobenzene and said salt is calcium chloride ($CaCl_2$) containing water of crystallization (approximately $Cl_2.H_2O$).

10. The method of claim 1 wherein said explosive substance is 1,3,5-trinitrobenzene.

11. A non-explosive composition consisting essentially of a solid formed explosive substance selected from the group of 1,2,3-trinitrobenzene and 2,4-6-trinitrotoluene; and more than 50% by weight in an amount sufficient to render said explosive substance non-explosive of a particle formed, chloride ion-containing salt having substantially the same mean particle size as said explosive substance and being easily washed out of the composition with water.

12. The composition of claim 11 wherein the amount of said salt is at least about 55% by weight of the composition.

13. The composition of claim 11 wherein the mean particle size of said salt is not less than one-half of or twice as large as the mean particle size of said explosive substance.

14. The composition of claim 13 wherein said salt is calcium chloride ($CaCl_2$).

15. The composition of claim 13 wherein said salt is sodium chloride or iron (II) chloride ($FeCl_2$).

16. The composition of claim 11 wherein said salt is calcium chloride ($CaCl_2$).

17. The composition of claim 11 wherein said salt is sodium chloride or iron (II) chloride ($FeCl_2$).

18. The composition of claim 11 wherein said explosive substance is 1,3,5-trinitrobenzene.

19. A particle formed solid explosive substance rendered temporarily non-explosive obtained by the process of claim 1.

20. A particle formed solid explosive substance rendered temporarily non-explosive obtained by the process of claim 4.

* * * * *